US008973291B2

(12) United States Patent
Mayer et al.

(10) Patent No.: US 8,973,291 B2
(45) Date of Patent: Mar. 10, 2015

(54) MOTORIZED FOAM GREETING CARD

(71) Applicant: American Greetings Corporation, Cleveland, OH (US)

(72) Inventors: David Mayer, Bay Village, OH (US); Carol Miller, Twinsburg, OH (US); Dave Sapp, Avon Lake, OH (US); Lynne Shlonsky, Shaker Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/301,166

(22) Filed: Jun. 10, 2014

(65) Prior Publication Data

US 2014/0360064 A1 Dec. 11, 2014

Related U.S. Application Data

(63) Continuation-in-part of application No. 13/568,482, filed on Aug. 7, 2012, now Pat. No. 8,887,418, which is a continuation-in-part of application No. 13/459,553, filed on Apr. 30, 2012, now abandoned, which is a continuation of application No. 13/004,544, filed on Jan. 11, 2011, now Pat. No. 8,205,365.

(60) Provisional application No. 61/905,420, filed on Nov. 18, 2013.

(51) Int. Cl.

| | |
|---|---|
| ***G09F 1/00*** | (2006.01) |
| ***B42D 15/02*** | (2006.01) |
| ***B42D 15/04*** | (2006.01) |

(52) U.S. Cl.

CPC ..... *B42D 15/022* (2013.01); *B42D 15/042* (2013.01); *B42D 15/027* (2013.01)

USPC ..... 40/124.03; 40/547

(58) Field of Classification Search

CPC ..... G09F 9/305; G09F 13/04; G09F 13/00; G09F 27/00; G09F 1/00; F21K 9/00; G02B 6/0006; B42D 15/022; B42D 15/042; B42D 15/045

USPC ..... 40/547, 124.03

See application file for complete search history.

(56) References Cited

U.S. PATENT DOCUMENTS

| | | | | |
|---|---|---|---|---|
| 5,829,863 | A * | 11/1998 | Gutshall | 362/123 |
| 6,039,453 | A * | 3/2000 | Wang | 362/101 |
| 6,050,714 | A * | 4/2000 | Isabella | 362/568 |
| 6,322,421 | B1 * | 11/2001 | Hou | 446/485 |
| 6,692,331 | B1 * | 2/2004 | Lin | 446/353 |

* cited by examiner

*Primary Examiner* — Casandra Davis
(74) *Attorney, Agent, or Firm* — Christine Flanagan

(57) ABSTRACT

A greeting card which contains a foam body covered by a front and rear surface material and one or more cavities contained therein for accommodating components of a sound and motor module. The greeting card contains a mobile object, which in a preferred embodiment includes a bundle of individual fiber strands. The bundle of fiber strands are attached to the motor module such that activation of the motor module cause the bundle of fiber strands to separate and spin or twirl. The bundle of fibers strands are attached to the motor through an opening in an upper perimeter surface of the foam body. The bundle of fibers together with the printed front and back surface material combine to resemble a character having a tuft of hair which spins upon activation of the motor module. The greeting card also contains a sound module which plays back audio upon activation.

15 Claims, 3 Drawing Sheets

MOTORIZED FOAM GREETING CARD

RELATED APPLICATIONS

This application claims priority to U.S. Provisional Patent Application No. 61/905,420, filed on Nov. 18, 2013. This application is also a continuation-in-part of U.S. patent application Ser. No. 13/568,482, filed on Aug. 7, 2012, which is a continuation-in-part of U.S. patent application Ser. No. 13/459,553, filed on Apr. 30, 2012 (now abandoned), which is a continuation of U.S. patent application Ser. No. 13/004,544, filed on Jan. 11, 2011 (now U.S. Pat. No. 8,205,365).

FIELD OF THE INVENTION

The present invention is in the field of social expression products. More specifically the invention is in the field of greeting cards having motorized effects.

SUMMARY OF THE INVENTION

A greeting card which contains a foam body covered by a front and rear surface material and one or more cavities contained therein for accommodating components of a sound and motor module. The greeting card contains a mobile object, which in a preferred embodiment includes a bundle of individual fiber strands. The bundle of fiber strands are attached to the motor module such that activation of the motor module cause the bundle of fiber strands to separate and spin or twirl. The bundle of fibers strands are attached to the motor through an opening in an upper perimeter surface of the foam body. The bundle of fibers together with the printed front and back surface material combine to resemble a character having a tuft of hair which spins upon activation of the motor module. The greeting card also contains a sound module which plays back audio upon activation.

DETAILED DESCRIPTION OF PREFERRED AND ALTERNATE EMBODIMENTS

The present invention includes a foam greeting card having audio and motorized effects. A foam greeting card body contains one or more cavities therein into which electronic components of the greeting card are inserted. The front and rear surfaces of the foam greeting card body is covered by a planar sheet material which conceals the foam and inner electronic components of the greeting card. The greeting card may additionally contain one or more mobile objects which are attached to a motor within the greeting card. The mobile object may come in a variety of shapes, sizes and textures.

The greeting card body 10, in a preferred embodiment, includes a single piece of hardened foam or foam-like material. The foam may be formed into any shape or profile, examples which include, but are not limited to: a cupcake, a tree, a dog, a person, a character, etc. The greeting card body

Figure 4:
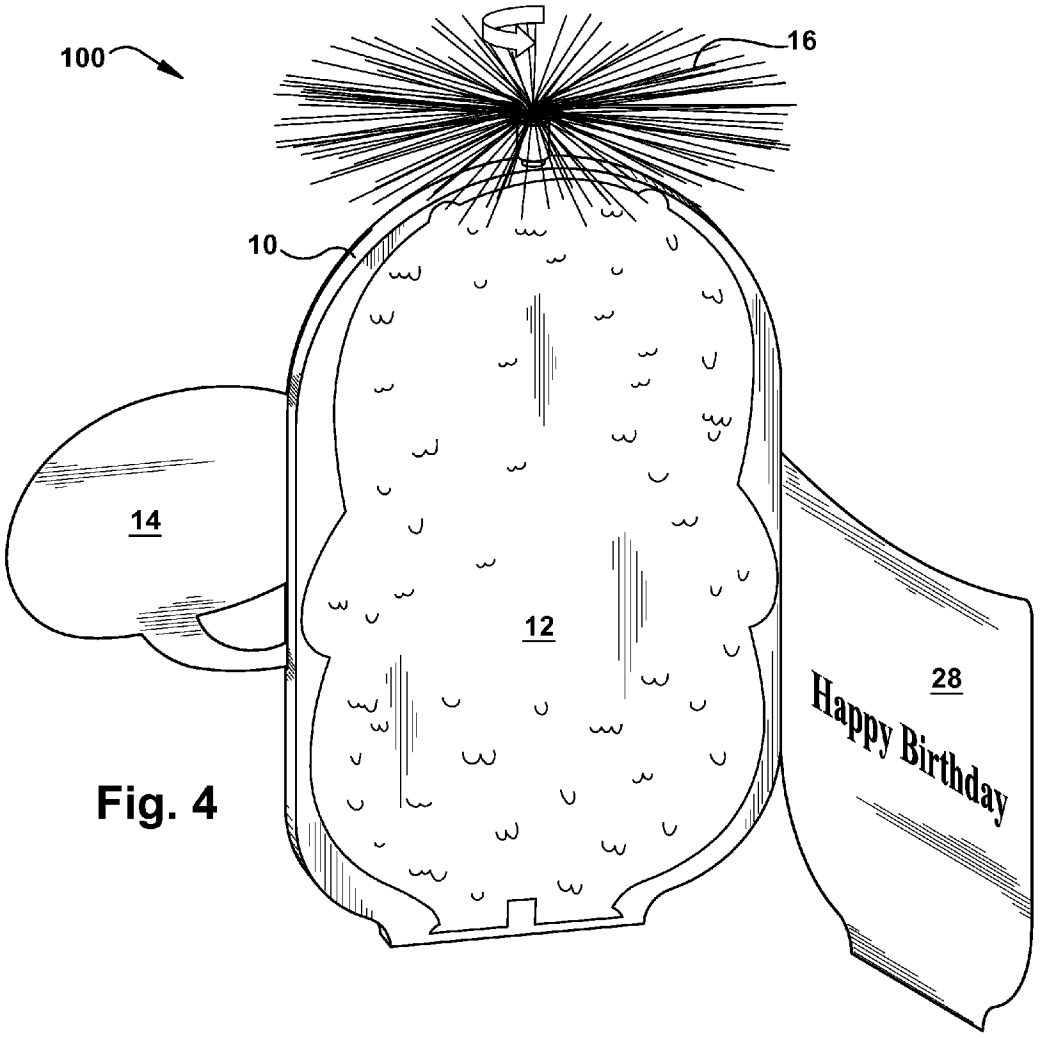
FIG. 4 is a rear view of the greeting card of FIG. 1 with sentiment panel opened and pivot panel in second position.

10 may alternatively be shaped like a traditional rectangular greeting card. The foam body 10 contains a cavity therein to accommodate a device such as, for example, a motor module, a sound module, a light module, a multimedia player device, or any other such device or combination of devices. There may be multiple cavities carved into the foam 10 to receive multiple devices or device components such as, for example, batteries 22 or other power source, a speaker 24, a circuit board 20, a switch 18, a motor 26, a memory device, a recording device, etc. The foam shape 10 has a generally planar front and rear surfaces with a thickness or outer perimeter therebetween. The foam 10 is both lightweight for ease of handling and to facilitate postal mailing and sturdy for the protection of the electronic components of the greeting card. The foam body 10 may be covered by a sheet material 12 made of heavy gauge paper-like material such as paper, cardboard, cardstock or any other like material. In an alternate embodiment, the sheet material 12 may be made of plastic or other lightweight, durable material. The sheet material 12 is generally cut into the shape of the foam body 10. The front surface material 12 may contain printing thereon of a front view of a character, animal or other object while the rear surface material 12 may contain printing thereon of a rear view of a character, animal or other object which matches the front surface material. The front and rear surface materials 12 may alternately contain right and left side views of a character, animal or other object. The surface material 12 is attached adhesively or otherwise to the foam body 10. The material 12 can also further contain three-dimensional embellishments such as gems, googly eyes, and other such adornments. In addition to the front and rear surface material 12, the greeting card 100 may contain an additional panel, referred to herein as a sentiment panel 28. The sentiment panel 28 is connected along a fold line to either the front or rear surface material 12. It is folded over the front or rear surface material 12 and serves as a front or rear cover of the greeting card. If the sentiment panel 28 is attached to the front surface material 12, it would serve as the front cover of the greeting card and the left inside panel while the front surface material 12 would serve as the right inside panel of the greeting card. If the sentiment panel 28 is attached to the rear surface material 12, as shown in FIG. 4, it would serve as the rear cover of the greeting card and the inside left panel while the rear surface material 12 would serve as the left inside panel of the greeting card. In either case, pivoting the sentiment panel 28 away from the foam body 10 reveals an inner surface onto which a greeting may be contained. The sentiment panel 28, along with the front and rear surface material 12 may contain text sentiment, drawings, photographs, drawings or any other printed material. The sentiment panel 28 may be shaped and/or decorated similar to the foam body and front and rear surface material 12. The sentiment panel 28 can cover the entire front or rear surface of the foam body 10 or it may cover only a portion thereof.

Figure 2:
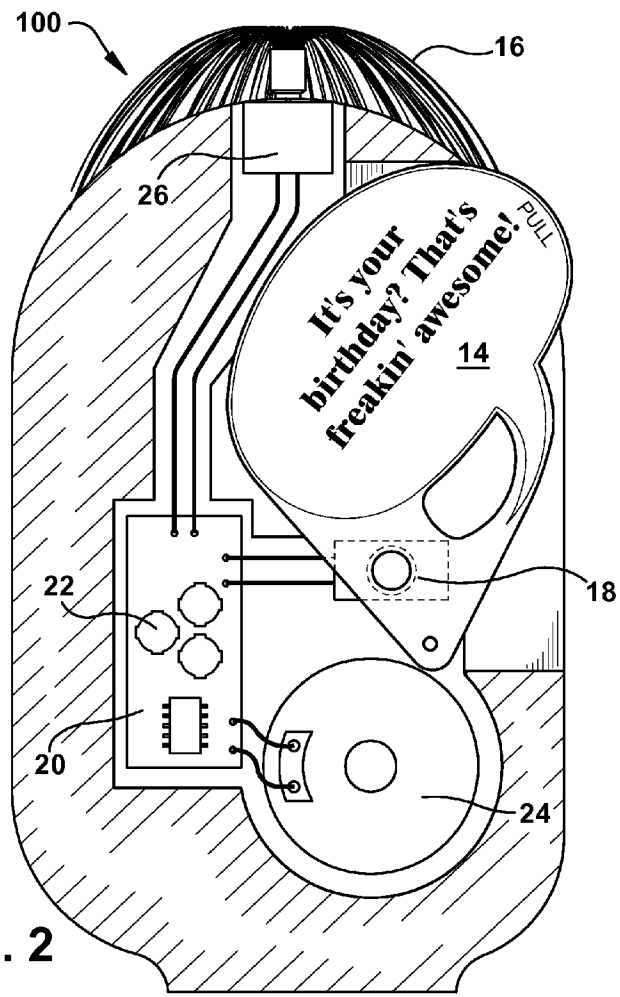
FIG. 2 is a front tear away view of the internal components of the greeting card of FIG. 1 in the direction of arrows 2-2, with pivot panel in a first position.
Figure 3:
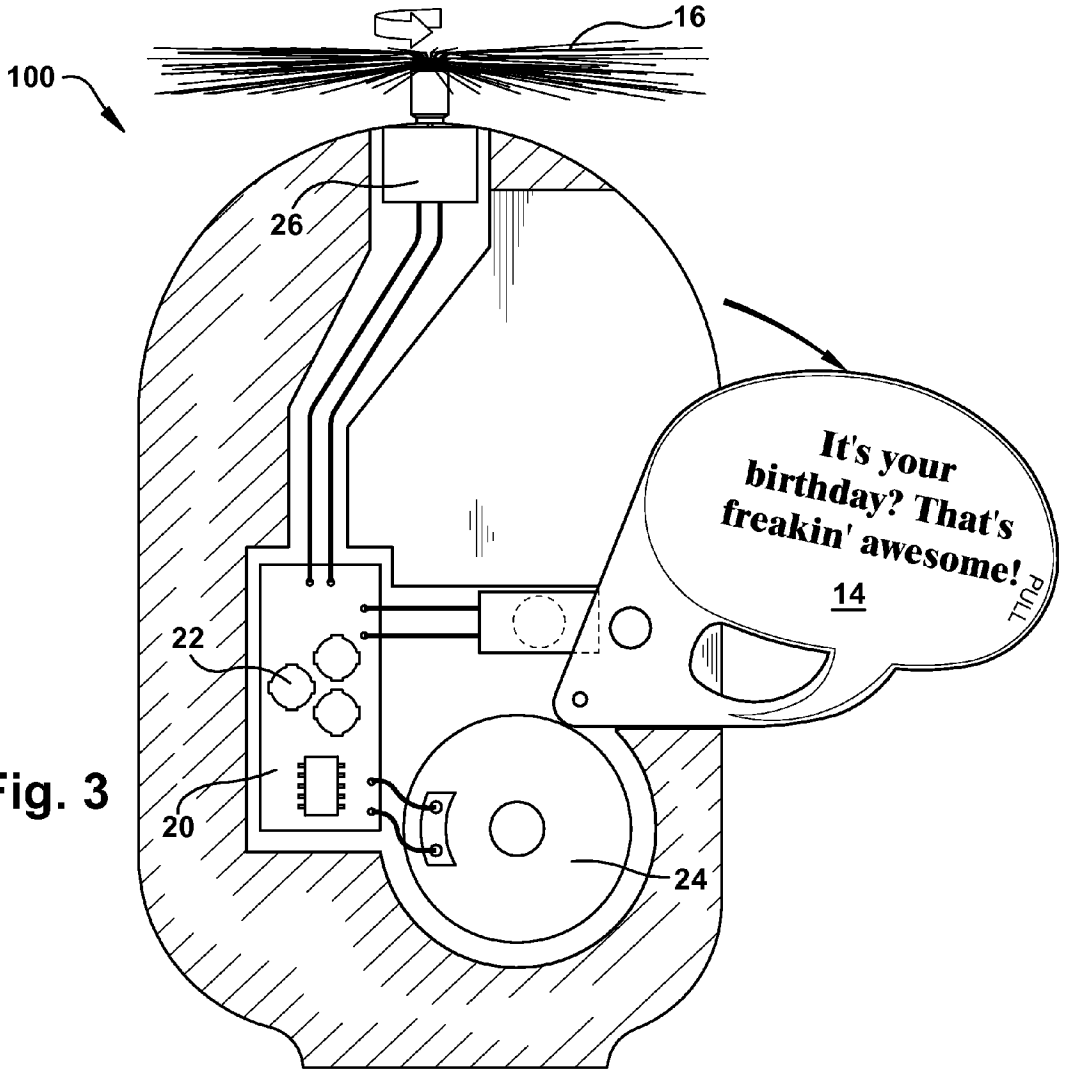
FIG. 3 is a front tear away view of the internal components of the greeting card of FIG. 1, with pivot panel in a second position.

As mentioned above, in a preferred embodiment, the greeting card 100 contains a sound module which is contained within one of the one or more cavities or compartments in the foam body 10. The sound module is operative to store and playback one or more audio files. The audio files may contain clips of music, singing, spoken word, animal sounds, or any other recordable sound. The sound module may be activated to replay the one or more audio files by a switch 18. The switch 18 may be a slide tongue switch, a contact switch, a button switch, a light sensitive switch, a contact switch, a motion sensitive switch, a touch sensitive switch or any other type of switch which is known to one having skill in the art. In the preferred embodiment, the switch 18 is a contact switch. A contact switch 18 contains two arms which when in contact, complete an electrical circuit. Separating the two arms breaks the circuit. A small pivot panel 14 is contained beneath the front surface material 12 and inserted in a slot between the front surface material 12 and the foam body 10 and between the two arms of the contact switch. When the pivot panel 14 is in a first position, it is contained between the two arms of the contact switch and substantially within the greeting card body 10 with a portion of the panel 14 visible beyond the front surface material 12. Pivoting the pivot panel 14 by, for example, grasping the visible portion of the pivot panel 14 between ones thumb and forefinger and pivoting the panel 14 downward, the pivot panel 14 moves into a second position wherein it is removed from between the two arms of the contact switch 18, allowing the arms to make contact and complete the electrical circuit, and it is substantially contained outside of the greeting card 100 beyond the front surface material 10. When the pivot panel 14 is moved from the first to the second position, the electrical circuit is complete and thereby providing power to the sound module which will replay one of the one or more audio files. When the pivot panel 14 is moved from the second position, back to the first position, it is again inserted between the two arms of the contact switch 18, thereby breaking the circuit and deactivating the sound module. The pivot panel 14 may contain an extra surprise greeting, text sentiment or artwork, etc. printed thereon. A portion of the pivot panel 14 may contain the word "pull" printed thereon to instruct the user to pull the panel for further entertainment. The pivot panel 14 may be shaped and printed to look like a conversation bubble and may have a greeting printed thereon which incorporates the theme of the greeting card or the character, etc. upon which the shape and appearance of the foam greeting card body are based, as shown in FIGS. 2 and 3.

In addition to activating the sound module upon moving the pivot panel 14, the contact switch 18 also controls power to a motor module. The motor module is also contained within the one or more cavities of the foam greeting card body 10. The motor module contains a small or miniature motor 26 which is used to effect movement of an object attached thereto. The motor module may cause a circular motion, bouncing or up-and-down motion, side-to-side or back-and-forth motion, a quick vibrating motion, or any other type of motion. A mobile object 16 is connected to the motor 26 either directly or via a connection arm. When the motor module is activated, the motor 26 is powered up causing movement of the mobile object 16. The mobile object 16 can be any type of small, lightweight figure. Examples include, but are not limited to: planar or three-dimensional die cut shapes, planar plastic shapes, three-dimensional plastic moulded shapes, strands of ribbon, etc. In a preferred embodiment, the mobile object 16 is a bundle of strings or lightweight fiber strands which are intended to look like a tuft of hair atop the head of a character (the foam body). The bundled strands 16 are connected at one end to the motor 26 and at the opposite ends are free such that when the motor 26 is activated, the bundle 16 is quickly moved in a circular motion, causing the bundled strands 16 to separate and spin or twirl as a bunch. The strands 16 may be made of yarn, rubber, plastic, or any other type of synthetic or non-synthetic material. The strands 16 may be of a single color or may contain a variety of different colors. In alternate embodiments, the mobile object may be a different type of hair style or may represent a facial feature, a body part of a person or animal, or other appendage.

Figure 1:
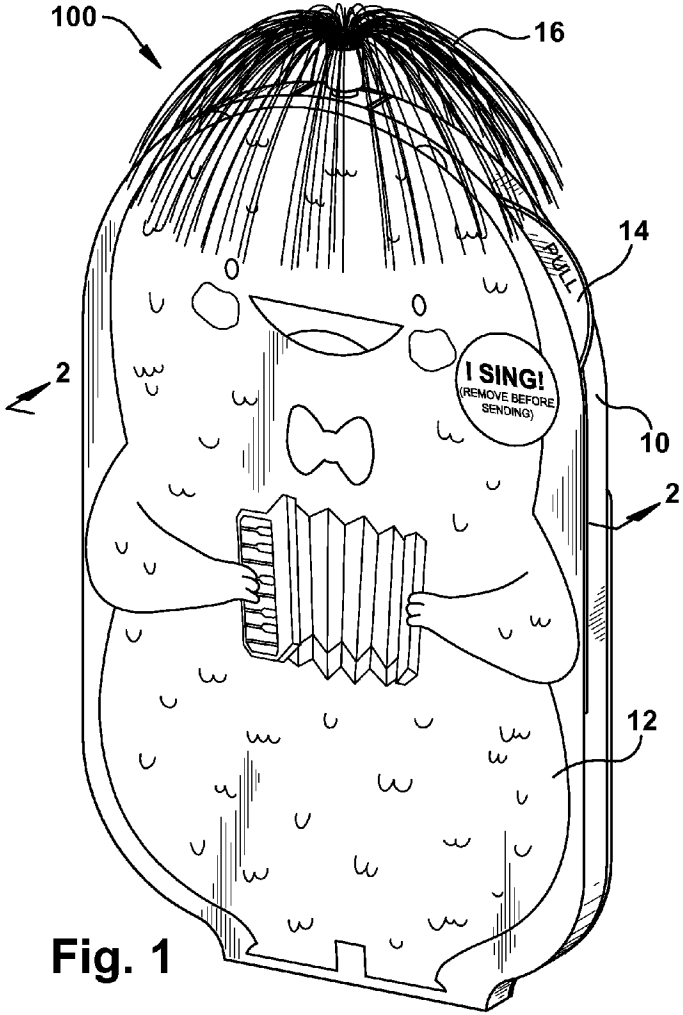
FIG. 1 is a perspective view of the front of the greeting card.

In a preferred embodiment, the sound and motor module are both controlled by the contact switch 18. Therefore, the process described above with respect to the contact switch 18 and pivot panel 14 apply to the activation of the motor module as well as the sound module. In alternate embodiments, the sound and motor modules may be controlled by different switches which may be of the same type of switch or different. When the pivot panel 14 is in its first position, shown in FIGS. 1 and 2, the sound and motor modules are deactivated. Moving the pivot panel 14 from the first to second position, shown in FIGS. 3 and 4, causes simultaneous activation of the sound and motor modules and causing playback of an audio file and movement or spinning of the mobile object (fiber strands) 16. Moving the pivot panel 14 from the second position back to the first position again deactivates the sound and motor module causing the sound and movement of the mobile object 16 to cease.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated.

The invention claimed is:

1. A greeting card comprising:

a foam body having one or more cavities therein;

a sound module operative to store and playback at least one audio file;

a motor module operative to cause movement to a mobile object;

a switch operative to control activation of the sound and motor modules;

the mobile object comprising a bundle of fiber strands which twirl in a circular motion when the motor module is activated;

wherein front and rear surface material attached to the foam body and the mobile object combine to depict a character with a tuft of hair that twirls upon activation of the motor module.

2. The greeting card of claim 1, wherein the mobile object is a bundle of individual strands which are attached to the motor module at one end.

3. The greeting card of claim 1, wherein the mobile object is a bundle of individual strands which are each freely moveable upon activation of the motor module.

4. The greeting card of claim 1, wherein the mobile object is a bundle of individual yarn strands.

5. The greeting card of claim 1, wherein the mobile object twirls in a circular motion.

6. The greeting card of claim 1 wherein the switch is a contact switch.

7. The greeting card of claim 6 further comprising a pivot panel which is moveable from a first position between opposing arms of the contact switch and a second position outside of the arms of the contact switch.

8. A greeting card comprising:

a greeting card body;

a sound module operative to store and replay at least one audio;

a motor module operative to cause motor movement of a mobile object;

the sound and motor modules contained within one or more cavities in the greeting card body;

a mobile object comprising a bundle of a plurality of individual strands of material, a first end of each of the plurality of individual strands attached to the bundle and the opposite end of each of the plurality of strands are unattached;

a contact switch which controls activation of the sound and motor modules;

a word bubble panel which is operative to control activation of the contact switch; wherein upon activation of the sound and motor modules, the at least one audio file is replayed and the bundle of individual strands of material are set into a spinning or circular motion; and a sentiment panel attached to the back side of the greeting card body.

9. The greeting card of claim 8, wherein the plurality of individual strands of material are made of yarn.

10. The greeting card of claim 8, wherein the plurality of individual strands of material are made of rubber.

11. The greeting card of claim 8, wherein the greeting card body is foam.

12. A greeting card comprising:

a greeting card body having at least one cavity contained therein;

a motor module contained within the at least one cavity in the greeting card body, the motor module operative to cause movement of a mobile object attached to the greeting card body;

a mobile object comprising a bundle of individual strings, each individual string being attached at one end to the bundle;

a sound module operative to store and playback at least one audio file;

a switch operative to control activation of the motor and sound modules;

wherein when the motor module is activated, the mobile object begins to move and each of the individual strings are spread apart in a circular motion.

13. The greeting card of claim 12, wherein the greeting card body is made of foam.

14. The greeting card of claim 13, wherein the front and rear surfaces of the greeting card body are covered by a planar sheet material.

15. The greeting card of claim 12, wherein the mobile object extends outward from a perimeter of the greeting card body.

* * * * *